United States Patent [19]

Ushiyama et al.

[11] Patent Number: 4,514,485

[45] Date of Patent: Apr. 30, 1985

[54] DEVELOPER FOR ELECTROPHOTOGRAPHY HAVING CARRIER PARTICLES, TONER PARTICLES AND ELECTROCONDUCTIVE FINE POWDERS

[75] Inventors: Hisayuki Ushiyama, Hiratsuka; Hisayuki Ochi; Tatsuo Miyamae, both of Tokyo; Katsutoshi Wakamiya, Kawasaki, all of Japan

[73] Assignee: Canon Kabushiki Kaisha, Tokyo, Japan

[21] Appl. No.: 409,500

[22] Filed: Aug. 19, 1982

[30] Foreign Application Priority Data

Sep. 3, 1981 [JP] Japan ..... 56-139164

[51] Int. Cl.[3] ..... G03G 9/14

[52] U.S. Cl. ..... 430/106.6; 430/107; 430/111; 430/110

[58] Field of Search ..... 430/106.6, 107, 111, 430/110

[56] References Cited

U.S. PATENT DOCUMENTS

| | | | |
|---|---|---|---|
| 2,874,063 | 2/1959 | Grieg . | |
| 3,725,118 | 4/1973 | Fuller et al. . | |
| 3,778,262 | 12/1973 | Queener et al. . | |
| 4,242,434 | 12/1980 | Hirakura et al. | 430/106.6 |
| 4,379,824 | 4/1983 | Collins | 430/106.6 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

An electrophotographic developer comprises magnetic particles coated with a low surface energy resin, toner particles and electroconductive fine powders. This developer can develop solid areas uniformly and does not form fog.

8 Claims, No Drawings

DEVELOPER FOR ELECTROPHOTOGRAPHY HAVING CARRIER PARTICLES, TONER PARTICLES AND ELECTROCONDUCTIVE FINE POWDERS

BACKGROUND OF THE INVENTION

1. Field of the Invention

This invention relates to a developer for a magnetic brush development in electrophotography.

2. Description of the Prior Art

According to electrophotographic processes, electrostatic latent images are produced on a photoconductive material by an electrostatic means and when a developer composed of toner particles and carrier particles is applied to the electrostatic latent images, toner particles separate from carrier particles to develop the electrostatic latent images. Such developing method is disclosed, for example, in U.S. Pat. No. 2,874,063 concerning a magnetic brush developing method. In such developing method, toner particles are held on the surface of carrier particles whose particle size is larger than that of toner particles by electrostatic force. The electrostatic force is caused by triboelectric charges of opposite polarity to each other produced by contact of toner particles with carrier particles. In such development, it is necessary that the toner particles have a proper polarity and electric charge quantity capable of being selectively attracted to electrostatic latent images when the developer composed of the toner particles and carrier particles contacts the electrostatic latent images.

In case of conventional dry developer, during development the carriers, the carrier and the toner, and the carrier, the toner and machine parts collide with each other many times. The resulting mechanical stress and heat make the toner particles adhere to the surface of the carrier particles and form a toner film thereon. Once such phenomenon as above occurs, the permanent film on the surface of the carrier particles accumulates as the development is repeated, and therefore, the ordinary triboelectric charging caused by rubbing between toner and carrier is partly replaced by triboelectric charging caused by rubbing between toner and toner. As a result, the triboelectric charge quantity changes with the lapse of time and the copied image quantity is lowered.

The toner film formation on the carrier surface may be prevented by coating the carrier surface with a low surface energy material as illustrated in U.S. Pat. Nos. 3,778,262 and 3,725,118.

Such coating with a low surface energy material is effective to prevent the toner film formation and prolong the life of developer, but the low surface energy material is insulative, and therefore edge effect occurs intensely, solid areas can not be uniformly developed, and bias potential is difficult to apply so that fog is liable to form on the background.

SUMMARY OF THE INVENTION

An object of the present invention is to provide a developer capable of developing solid areas uniformly.

Another object of the present invention is to provide a developer which does not cause fog.

According to the present invention, there is provided an electrophotographic developer which comprises magnetic particles coated with a low surface energy resin, toner particles and electroconductive fine powders.

DESCRIPTION OF THE PREFERRED EMBODIMENTS

As a core material for the carrier, there may be used a magnetic material, for example, iron such as ground iron powder, electrolytic iron powder, reduced iron powder, sprayed iron powder, carbonyl iron powder and the like, nickel, ferrite, steel, chromium, cobalt, manganese and the like.

The shape of the carrier core material may be spherical, irregular, spongy, nodular and the like.

The average size of the core material is usually 20–1000 microns, preferably 30–200 microns, more preferably 40–60 microns.

As the low surface energy resin for coating the carrier core material according to the present invention, there is preferably used a low surface energy resin having a surface tension lower than that of the toner (usually 30–40 dyne/cm), that is, the surface tension of the low surface energy resin is preferably 15–30 dyne/cm, more preferably, 17–28 dyne/cm.

Typical low surface energy resins may be fluoroplastics such as polyvinyl fluoride, polyvinylidene fluoride, polytrifluoromonochloroethylene, polytetrafluoroethylene, tetrafluoroethylene-hexafluoropropylene copolymer, tetrafluoroethylene-perfluoroalkyl compound-fluoroalkyl vinyl ether copolymer, trifluoroethylene-ethylene copolymer and the like, enamels composed of the fluoroplastics and pigments, and enamels composed of the fluoroplastics and modified resins.

As low surface energy resins other than fluoroplastics, there may be mentioned silicon resins such as dimethylsilicone resins, methylphenyl silicone resins and the like and modified silicon resins.

The thickness of the low surface energy resin covering the carrier core material is preferably 5–20 microns, more preferably 8–15 microns for fluoroplastics and preferably 0.5–2 microns, more preferably 0.8–1.5 microns for silicon resins.

Electroconductive fine powders are added preferably in an amount of 1–10%, more preferably 2–5%, based on the weight of toner.

The resistivity of the electroconductive fine powders is measured by placing the powders in a cylindrical vessel, pressing the powders at 500 kg/cm$^2$ and applying an electric current. Preferable resistivity is 0.1–10$^5$ ohm.cm.

As the electroconductive fine powders, there may be used fine powders of tin oxide, silver, nickel, copper, aluminium, iron, carbon black, graphite, molybdenum sulfide, zinc oxide and the like. Among them, tin oxide, zinc oxide and molybdenum disulfide are particularly preferable.

Particle size of the electroconductive fine powders is preferably 0.001–1 micron, more preferably 0.01–0.5 micron.

The toner particles comprises binders, colorants, and if desired, magnetic powders and additives. Average particle size of the toner particles is preferably 5–30 microns, more preferably 10–15 microns. The weight ratio of toner particles to carrier particles preferably ranges from 2/98 to 10/90.

As binder resins for toners, there may be used various binder resins including known binder resins. Typical binder resins are styrene resins (homopolymers or copolymers containing styrene or substituted styrenes) such as polystyrene, polychlorostyrene, poly-α-methylstyrene, styrene-chlorostyrene copolymer, styrenepropylene copolymer, styrene-butadiene copolymer, styrene-vinyl chloride copolymer, styrene-vinyl acetate copolymer, styrene-maleic acid copolymer, styrene-acrylic acid ester copolymer (styrene-methyl acrylate copolymer, styrene-ethyl acrylate copolymer, styrene-butyl acrylate copolymer, styrene-octyl acrylate copolymer, styrene-phenyl acrylate copolymer and the like), styrene-methacrylic acid ester copolymer (styrene-methyl methacrylate copolymer, styrene-ethyl methacrylate copolymer, styrene-butyl methacrylate copolymer, styrene-phenyl methacrylate copolymer and the like), styrene-methyl α-chloroacrylate copolymer, styrene-acrylonitrile-acrylic acid ester copolymer and the like, vinyl chloride resins, ethylene-vinyl acetate copolymer, resin-modified maleic acid resins, acrylic resins, phenolic resins, epoxy resins, polyester resins, low molecular weight polyethylene, low molecular weight polypropylene, ionomer resins, polyurethane resins, silicone resins, ketone resins, ethylene-ethyl acrylate copolymer, xylene resins, polyvinyl butyral resins and the like.

Optional pigments or dyes may be used as colorants in the toner. Typical pigments and dyes are carbon black, iron black, phthalocyanine blue, ultramarine, quinacridone, benzidine yellow and the like.

When a magnetic toner is used, magnetic powders are added to the toner, and the magnetic powders may serve as a colorant.

As the magnetic powders, there may be used powders of conventional magnetic materials, for example, ferromagnetic elements such as iron, nickel, cobalt and the like, manganese, and alloys and compounds of the above mentioned elements and other ferromagnetic alloys. For example, magnetite, hematite, ferrite and the like may be used.

As other additives, there may be added carbon black, nigrosine, metal complexes, colloidal silica powders, fluoroplastic powders, and metal salts of higher fatty acids for the purpose of charge control, inhibition of agglomeration and the like.

The invention is further illustrated by the following examples.

EXAMPLE 1

To one kilogram of spherical iron powders of average particle size of 100 microns was sprayed 150 g of an epoxy-modified Teflon enamel ("Teflon S 954-101", tradename, supplied by Du Pont) diluted with the same quantity of methyl ethyl ketone at 45° -60 ° C. in a circulating fluidized bed of Wurster type and curing was carried out in a furnace at 400 ° C. for 15 min. followed by taking the cured matter out of the furnace and cooling to room temperature with the ambient air. Then the product was subjected to screening by a 100 mesh screen to remove agglomerates. Thus, carrier particles covered with a low surface energy resin were produced.

The carrier particles thus produced were then mixed with 3% by weight of a toner composed of styrene resin 90 parts by weight, nigrosine 5 parts by weight and carbon black 5 parts by weight and 0.1% by weight of tin oxide powder of 0.1 micron or less in particle size to prepare a developer.

The resulting developer was used for copying with an electrophotographic copying machine NP-8500 (tradename, manufactured by Canon K.K.). The resulting images were free from edge effect and the black solid area was uniformly developed, and attachment of toner particles to the background was not observed.

Repeating the above procedure except that the 0.1% by weight of tin oxide powder was not added, the resulting images were intensely affected by edge effect so that the center portion of black solid areas became white (i.e. black solid areas were not uniformly developed) and much toner attached to the background.

EXAMPLE 2

One kilogram of spongy iron powders of 40 microns of average particle size (EFV, tradename, supplied by Nihon Teppun K.K.) was sprayed with 200 g of a 10% solution of a silicone varnish (SR-2406, tradename, manufactured by Toray Silicone Co.) in toluene at 85° -90° C. in a circulating fluidized bed of Wurster type and curing was effected in a furnace at 200 ° C. for 20 min. followed by taking the iron powders out of the furnace, cooling and then removing agglomerates by using a 150 mesh screen. Thus carrier particles covered with a low surface energy resin were produced.

The carrier particles thus produced were then mixed with 8% by weight of the toner as used in Example 1 above and 0.5% by weight of molybdenum disulfide of an average particle size 0.05 micron to prepare a developer.

The resulting developer was used for copying with NP8500, and the developed images were free from edge effect, of a high quality and free from fog.

EXAMPLE 3

Repeating the procedure of Example 1 except that carrier particles were coated with tetrafluoroethylene resin or vinylidenefluoride resin in the thickness of 5-10 microns, or with silicone resin or phenyl-modified silicone resin in the thickness of 1-2 microns, or with urethane-modified tetrafluroroethylene enamel in the thickness of 5-10 microns in place of the epoxy-modified Teflon enamel, there were obtained good results as in Example 1.

EXAMPLE 4

Repeating the procedure of Example 1 except that nodular iron powders of an average particle size of 70 microns were used in place of the spherical iron powders, there was obtained a good result as in Example 1.

EXAMPLE 5

Repeating the procedure of Example 1 except that zinc oxide of a partical size of 0.05 microns was used in an amount of 5% by weight based on the toner in place of tin oxide powders, there was obtained a good result as in Example 1.

EXAMPLE 6

Repeating the procedure of Example 1 except that a styrene-ethyl acrylate copolymer was used as a binder resin for toner, there was obtained a good result as in Example 1.

EXAMPLE 7

Repeating the procedure of Example 2 except that carrier particles were coated with tetrafluoroethylene resin or vinylidene fluoride resin in the thickness of 5-10 microns, or with silicone resin or phenyl-modified silicone resin in the thickness of 1-2 microns, or with urethane-modified tetrafluoroethylene enamel in the thickness of 5–10 microns in place of the silicone varnish, there were obtained good results as in Example 2.

EXAMPLE 8

Repeating the procedure of Example 2 except that nodular iron powders of an average particles size of 70 microns were used in place of the spongy iron powders, there was obtained a good result as in Example 2.

EXAMPLE 9

Repeating the procedure of Example 2 except that zinc oxide of a particle size of 0.05 microns was used in an amount of 5% by weight based on the toner in place of the molybdenum disulfide powders, there was obtained a good result as in Example 2.

EXAMPLE 10

Repeating the procedure of Example 2 except that a stryrene-ethyl acrylate copolymer was used as a binder resin for toner, there was obtained a good result as in Example 2.

What we claim is:

1. An electrophotographic developer which comprises magnetic particles coated with a low surface energy resin, toner particles and electroconductive fine powders from 0.001–1 micron selected from tin oxide and zinc oxide.

2. An electrophotographic developer according to claim 1 in which the low surface energy resin has a surface tension of 15–30 dyne/cm.

3. An electrophotographic developer according to claim 1 in which the low surface energy resin is fluoroplastics.

4. An electrophotographic developer according to claim 3 in which the thickness of the fluoroplastics coating on the magnetic particles is 5–20 microns.

5. An electrophotographic developer according to claim 1 in which the low surface energy resin is silicone resin.

6. An electrophotographic developer according to claim 5 in which the thickness of the silicone resin coating on the magnetic particles is 0.5–2 microns.

7. An electrophotographic developer according to claim 1 in which the resistivity of the electroconductive fine powders is $0.1–10^5$ ohm.cm.

8. An electrophotographic developer according to claim 1 in which the amount of the electroconductive fine powders is 1–10% base on the weight of the toner.

* * * * *

UNITED STATES PATENT AND TRADEMARK OFFICE

CERTIFICATE OF CORRECTION

PATENT NO. : 4,514,485

DATED : April 30, 1985

INVENTOR(S) : HISAYUKI USHIYAMA, ET AL.

It is certified that error appears in the above-identified patent and that said Letters Patent is hereby corrected as shown below:

Column 2, line 49, after "tin oxide" insert --and zinc oxide.--; delete balance of paragraph.

Column 4, line 24, change "8%" to --5%--.

Column 4, line 25, change "molybdenum disulfide" to --zinc oxide--

Column 4, line 26, after "size" insert --of--

Column 4, line 51, change "partical" to --particle--.

Signed and Sealed this

*Twenty-fourth* Day of *June 1986*

[SEAL]

*Attest:*

DONALD J. QUIGG

*Attesting Officer* *Commissioner of Patents and Trademarks*